US006283362B1

(12) United States Patent
Michlin

(10) Patent No.: US 6,283,362 B1
(45) Date of Patent: Sep. 4, 2001

(54) COMPOSITE FORM STRUCTURE

(76) Inventor: Irving R. Michlin, 255 David Rd., Salt Point, NY (US) 12578

( * ) Notice: Subject to any disclaimer, the term of this patent is extended or adjusted under 35 U.S.C. 154(b) by 0 days.

(21) Appl. No.: 09/557,374

(22) Filed: Apr. 25, 2000

(51) Int. Cl.[7] ..... B65D 27/14
(52) U.S. Cl. ..... 229/70; 229/68.1; 462/64
(58) Field of Search ..... 229/70, 68.1; 462/64

(56) References Cited

U.S. PATENT DOCUMENTS

| | | | | |
|---|---|---|---|---|
| 240,646 | * | 4/1881 | Blair | 229/68.1 |
| 2,112,227 | * | 3/1938 | Berkowitz | 229/70 |
| 2,835,512 | * | 5/1958 | Whitman | 229/70 |
| 3,104,800 | * | 9/1963 | Johnson et al. | 229/70 |
| 3,243,205 | * | 3/1966 | Borgquist | 229/70 |
| 3,460,743 | * | 8/1969 | Burnett | 229/70 |
| 3,467,299 | * | 9/1969 | Meyer | 229/70 |
| 4,708,285 | * | 11/1987 | Segall | 229/68.1 |
| 5,377,904 | * | 1/1995 | Michlin et al. | 229/70 |
| 6,062,465 | * | 5/2000 | Kearns | 229/70 |
| 6,089,613 | * | 7/2000 | Petkovsek | 229/70 |

* cited by examiner

*Primary Examiner*—Stephen P. Garbe
(74) *Attorney, Agent, or Firm*—Francis C. Hand; Carella, Byrne, Bain, Gilfillan, Cecchi, Stewart & Olstein

(57) ABSTRACT

A composite letterhead/envelope form is provided which can be fed through a printer for imaging both the letterhead and the envelope in one pass. The form includes a letterhead of substantially a standard size which is releasably attached to a flap of a separately fabricated envelope. After imaging, the letterhead is readily removed from the envelope, folded, and then stuffed into the pocket of the envelope. A flap of the envelope seals the pocket of the envelope. The letterhead may be of heavier stock than the envelope.

23 Claims, 3 Drawing Sheets

COMPOSITE FORM STRUCTURE

This is a provisional application for patent.

This invention relates to a composite form structure. More particularly, this invention relates to a composite letterhead and envelope form structure.

As is known, various types of forms have been used for mailing purposes. For example, U.S. Pat. No. 2,152,135 describes the use of a single sheet of letter sized paper which can be folded and used as a mailing envelope. U.S. Pat. No. 4,951,864 describes a one piece mailer which can be fed through a laser printer so as to be provided with variable information, such as address information, and thereafter folded for mailing purposes.

Mailer constructions have also been known which are made up in a continuous form assembly wherein each section of the assembly provides a form constituted by an envelope and a contiguous insert portion which can be separated from the envelope and subsequently inserted into the envelope for mailing purposes.

It has also been known that form letters, or personalized letters, can be readily processed and imaged in laser printers and the like using personal computers. It is also known that in order to address an envelope for such a letter, the envelope had to be inserted in a typewriter or inserted separately into a printer, such as a laser or dot matrix printer. Thus, where multiple letters are imaged with personalized information and separate multiple envelopes are addressed in a typewriter or otherwise, there is a risk that the correct insert would not be stuffed in the correct envelope.

U.S. Pat. No. 5,377,904 describes a mailer form having an envelope portion integrated with a letterhead or insert portion to permit feeding through an imaging device such as a laser printer whereby both the letterhead portion and the envelope portion can be imaged at the same time.

It is an object of this invention to provide a composite form structure having an ability to be processed through a laser printer, ink jet printer, or other imaging machine in an efficient and reliable manner.

It is another object of the invention to provide a composite form structure which can be readily used in the home, by small businesses and the like.

It is another object of the invention to provide a mailer form which permits imaging of a letter and addressing of an envelope in one pass through an imaging machine such as a laser printer, ink jet printer and the like.

It is another object of the invention to provide a composite form structure in which a letterhead provides a relatively large surface area for imaging.

It is another object of the invention to provide a composite form structure having a letterhead of a size close to a standard 8½ by 11 inch sizes.

Briefly, the invention is directed to a composite form structure comprising a letterhead and an envelope which are separately made and which are releasably attached one to the other.

The letterhead is constructed of rectangular shape with a predetermined width, a predetermined length and a predetermined thickness, i.e. a predetermined weight such as twenty-four pound stock.

The envelope is constructed with a pocket of a width greater than the width of the letterhead and a height greater than the length of the letterhead when folded in order to receive the letterhead in a folded-over condition. The envelope may also have a thickness less than the thickness of the letterhead, i.e. a weight less than the weight of the letterhead. For example, the envelope may have a weight of twenty pound stock while the letterhead has a weight of twenty-four pound stock. The purpose of this is to reduce the difference in thickness when the composite form structures are stacked in feeders and, thus, to improve feeding. In addition, the envelope has a flap which extends beyond the pocket for folding over in order to close the pocket after the folded over letterhead has been placed in the pocket.

In accordance with the invention, the letterhead is releasably attached to the flap of the envelope in an overlapping manner and so that the letterhead and envelope are movable as a unit through a printer for placement of imaging on each.

The letterhead may be releasably attached to the flap of the envelope in various manners. In a first embodiment, a fugitive type adhesive or removable adhesive or repositionable type adhesive is placed between the letterhead and the flap in order to permit the letterhead to be manually removed from the flap. In a second embodiment, a line of glue may be used to permanently attach the letterhead to the flap with a major portion of the letterhead being subsequently detached by use of a micro-perforation or other perforation in the letterhead which leaves a small stub of the letterhead on the envelope. In a third embodiment, a spot glue may be used to attach the letterhead to the flap of the envelope.

The flap is also provided with an adhesive for sealing of the flap to the envelope in order to close the pocket. For example, a remoistenable glue or a pressure sensitive glue covered by a removable tape may be used.

When using a releasable adhesive, the adhesive should be of a type so that any residue of the adhesive would remain on the envelope flap rather than on the letterhead. Once the flap is folded over to close the pocket of the envelope, any residue will be hidden from view.

The letterhead may be sized close to a standard 8½ inch by 11 inch paper size while also approximating the same relationship. Optionally, the letterhead may be sized to be of A4 size, or of a size close to a Monarch size, i.e. 7¼ inches by 10⁷⁄₁₆ inches, or of a greeting card size.

When folded in thirds, the letterhead should ideally fit into the envelope without further folding. Since the letterhead is narrower than the envelope, the letterhead may easily slide into the envelope without having to be folded to reduce the width.

The letterhead and envelope may be aligned so that one edge of the letterhead lines up with one edge of the envelope to assure that the composite form feeds straight into a printer.

In one embodiment, the letterhead is positioned over the adhesive on the flap of the envelope in order to insulate the adhesive from the heat of a laser printer drum. This construction is also ideally suited for ink jet printers and may also be used on printers employing other imaging technologies.

In still another embodiment, the letterhead may be positioned on the opposite side of the flap from the adhesive side of the flap.

In still another embodiment, the flap of the envelope can be compressed in the area that the letterhead is attached to the envelope. This has the advantage of minimizing any build-up or additional thickness in this area due to the adhesive on the flap.

The letterhead may incorporate additional features such as an identification card and/or a label and may be used for other means of communications such as invoices, statements or newsletters.

The envelope may also be provided with imaging, customized or otherwise, electronic postage, return and outgoing names and addresses and the like. Further, this imaging may be provided at the same time and in the same pass as the letterhead is imaged.

These and other objects and advantages of the invention will become more apparent from the following detailed description taken in conjunction with the accompanying drawings wherein.

Figure 1:
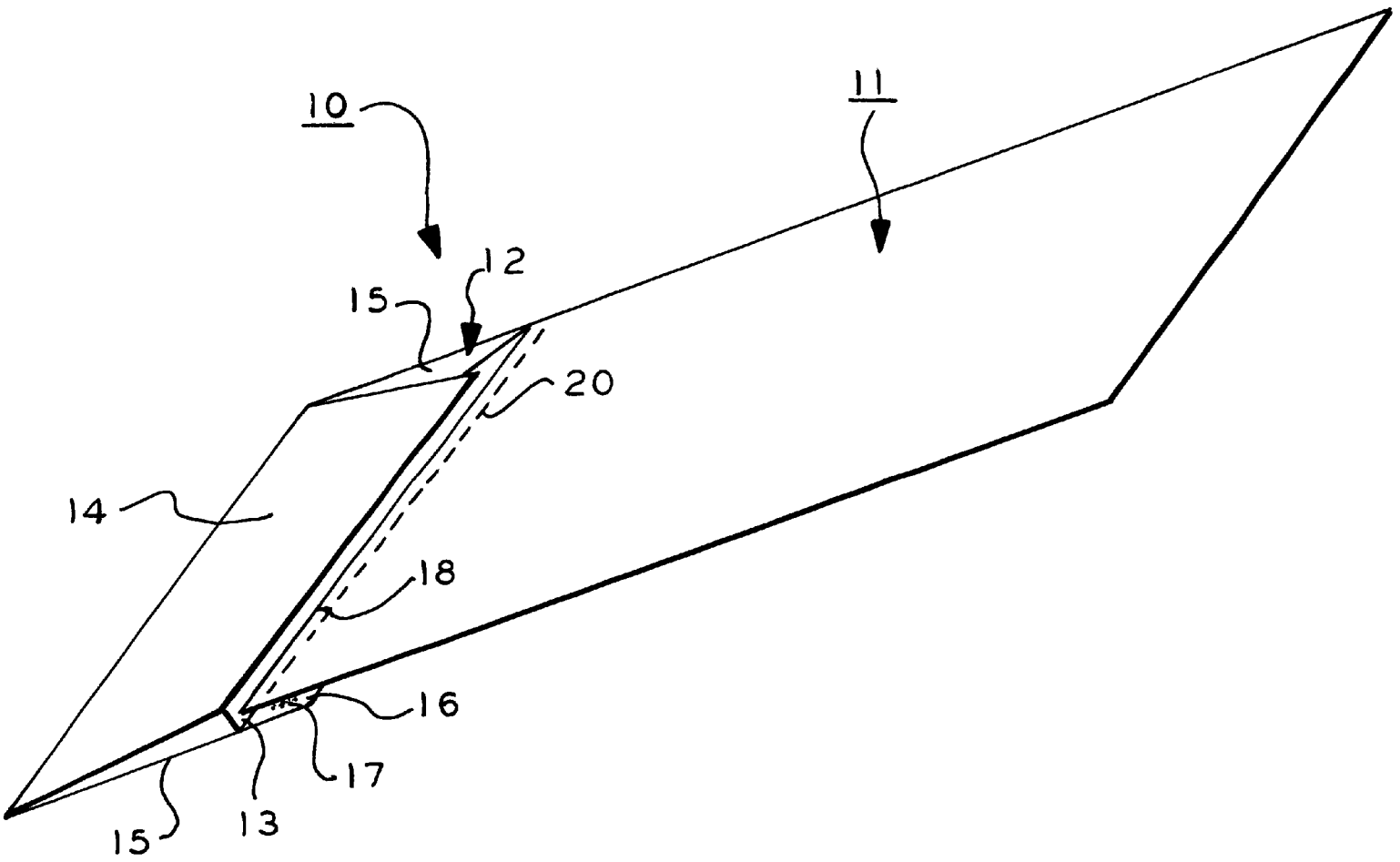
FIG. 1 illustrates a perspective view of a composite form structure constructed in accordance with the invention.
Figure 3:
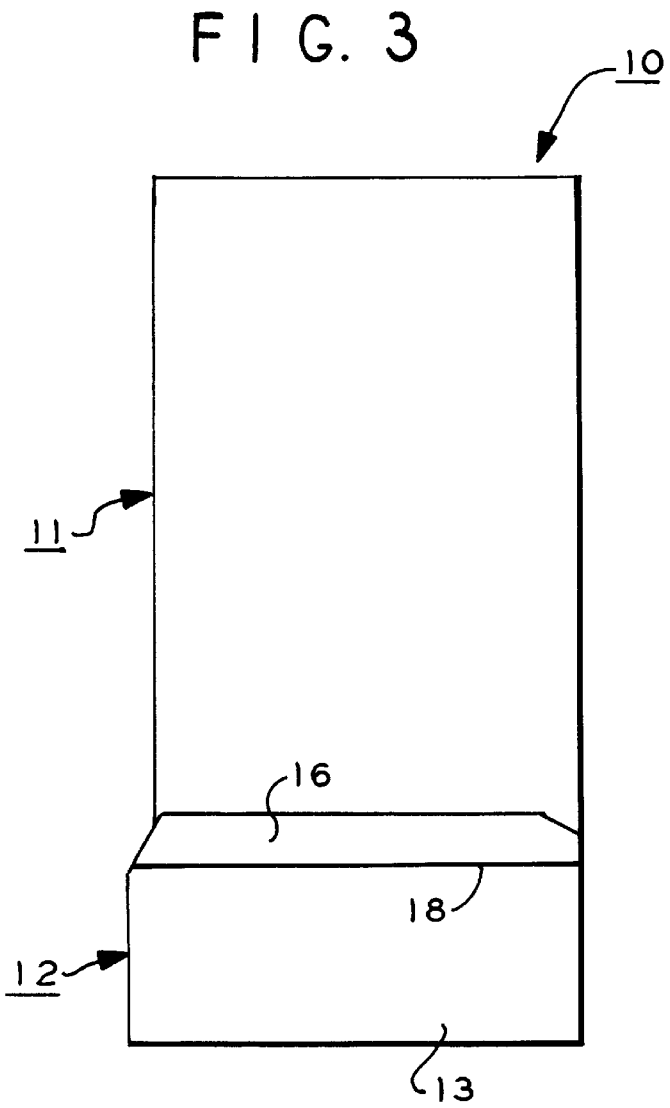
FIG. 3 illustrates a front view of the structure of FIG. 1.
Figure 2:
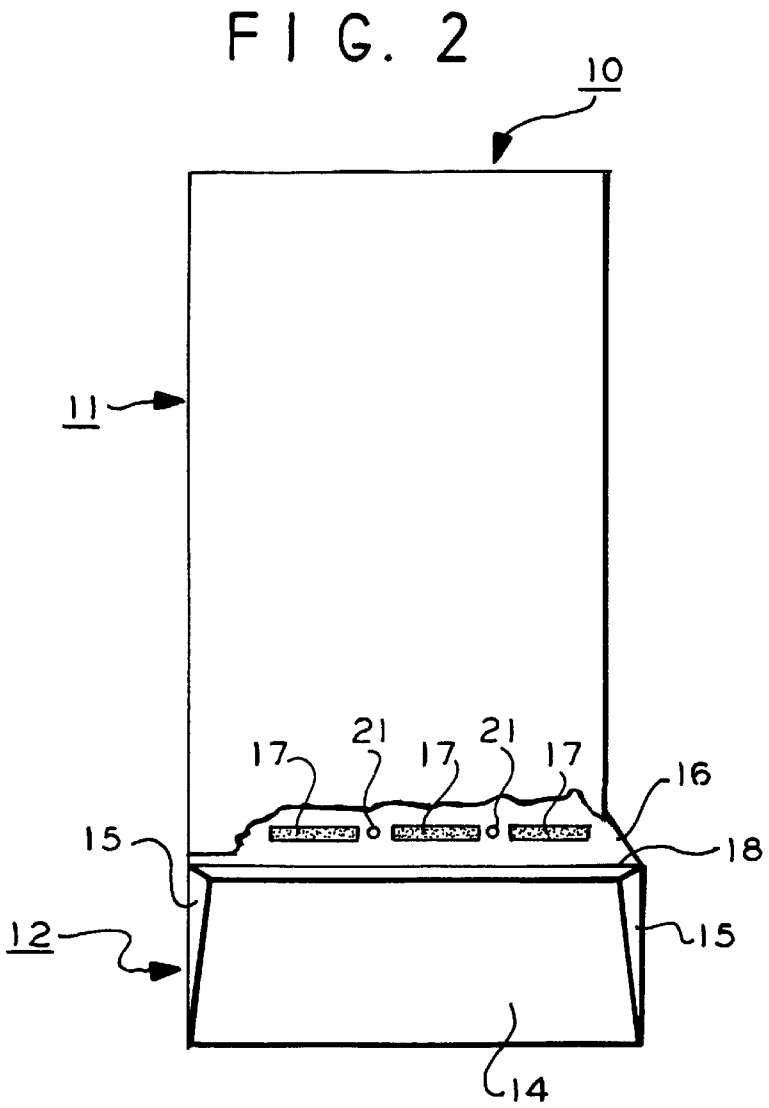
FIG. 2 illustrates a back view of the structure of FIG. 1.

Referring to FIGS. 1, 2 and 3, the composite form structure 10 includes a letterhead 11 and an envelope 12.

The letterhead 11 is of rectangular shape having a predetermined width, a predetermined length and a predetermined thickness (paperweight). For example, the letter 11 has a width of 8¼ inches and a length of 10½ inches while being of twenty-four pound stock.

The envelope 12 is formed with a pocket between a front ply 13 and a back ply 14 and may be a twenty-four pound stock or preferably a lesser stock weight such as twenty pound stock. In addition, the front ply 13 has a pair of tabs 15 (i.e. side flaps) at the sides which are folded inwardly and over which the back ply 14 is secured by a suitable adhesive in order to form a full pocket in the envelope. The envelope also has a flap 16 extending from the front ply 13. This flap 16 may be die cut to provide an appearance of a conventional flap or may be die cut to present other appearances.

The pocket of the envelope 12 is of a width greater than the width of the letterhead and of a height less than the length of the letterhead 11 in order to receive the letterhead 11 in a folded over condition.

As shown, the flap 16 extends beyond the pocket for folding over onto the back ply 14 in order to close the pocket. To this end, an adhesive 17 is disposed on the flap 16 for sealing of the flap 16 to the back ply 14 of the envelope in order to close the pocket. The front ply 13 of the envelope 12 is provided with a score line 18 about which the flap 16 may be folded onto the back ply 14.

For the illustrated example, the envelope 12 has a width of 8½ inches. Also, the front ply 13 has a length of 3.625 inches to the score line 18, the flap 16 has a length of 0.875 inches from the score line 18 and the back ply 14 has a length of 3.5 inches. Thus, when the flap 16 is folded over to close the pocket of the envelope, the height of the envelope may be 3½ inches or just over 3½ inches.

The overall size of the composite form structure 10 is 8½ inches by 14 inches with an almost full-size letterhead. As such, a plurality of such composite forms may be readily packaged or boxed in batches suitable for retail sales to end users in a manner similar to the packaging of 8½ by 14 inch paper. Further, the letterhead 11 and back ply 14 of the envelope are contiguous and co-planar when of the same weight or almost co-planar when of different stock weights. This facilitates imaging as the form structure 10 is fed through a printer. In the illustrated embodiment, the letterhead 11 may alternatively be spaced from the back ply 14 so that the length of the letterhead is slightly less than 10.5 inches. As a further alternative, the letterhead 11 may have a length to height ratio which is exactly the same as the 8½ inch to 11 inch ratio of a standard letterhead.

Typically, the composite structure 10 would be supplied in bulk with multiple copies supplied in a box or packet. The user would simply open the box or packet and place one or more of the form structures 10 in a feeder of a printer, such as a laser or ink jet printer. Information may then be inputted into a personal computer for printing onto the composite form structure 10.

By way of example, the composite form structure 10 is fed into the printer envelope end first so that imaging may be applied to a major portion of the exposed portion of the letterhead 11 and the front ply 13 of the envelope 12. The imaging of the front ply 13 of the envelope 12 permits an address and a return address to be printed thereon. Postal indicia or electronic postage may also be imaged on the envelope.

Figure 4:
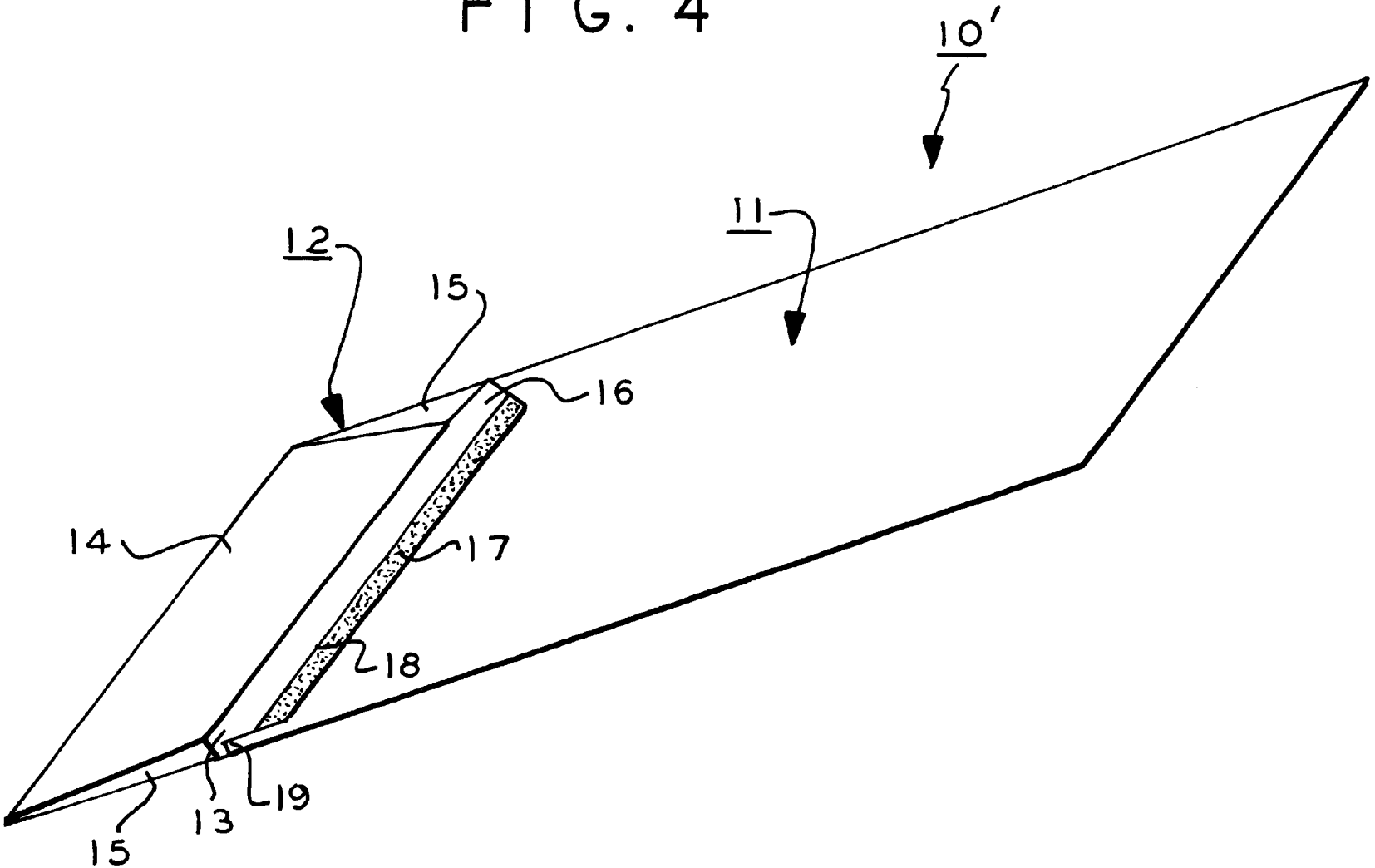
FIG. 4 illustrates a perspective view of a modified composite form structure in accordance with the invention.

Referring to FIG. 4, wherein like reference characters indicate like parts as above, in order to provide more surface area on the letterhead 11 for imaging, the letterhead 11 of the composite form structure 10' may be secured to the flap 16 on the front ply 13 side of the flap in the same manner as above. This provides the full length of the letterhead 11 for imaging and also the full face of the envelope 12.

In this alternative construction, the envelope flap 16 may be debossed into the letterhead 11 so that the form 10' lays flatter. In this respect, the debossing operation would effect a Z-bend 19 in the flap.

After a composite form 10, 10' has been imaged, the user would simply separate the letterhead 11 off the flap 16 of the envelope 12. The removed letterhead 11 would then be folded, for example, in thirds, and stuffed into the pocket of the envelope 12. The flap 16 is then folded at the score line 18 and the adhesive 17 on the flap 16 is employed to secure the flap 16 to the back ply 14 to close the pocket. In this respect, the adhesive 17 may be a water remoistenable glue or a pressure sensitive glue with tape 22 over the glue.

In the embodiment where the adhesive 17 is a remoistenable glue, a separate adhesive 21 is used to releasably attach the letterhead 11 to the flap 16, for example a fugitive type adhesive or a spot glue see FIG. 2. Alternatively, a line of glue may be used to permanently attach the letterhead 11 to the flap. In this case, the letterhead 11 would be provided with a micro-perforation (see FIG. 1) to leave a small stub after the remainder of the letter 11 has been removed from the envelope 12. This small stub would be hidden from view when the flap 16 is folded over to close the pocket of the envelope 12.

The type of glues used for releasably attaching the letterhead 11 to the flap 16 of the envelope 12 may include a pressure sensitive glue as sold by Craig Adhesives and Coatings Company of Newark, N.J. under the designation CRAIGLAM 1029LT.

In another embodiment, the overall dimensions of the composite structure may be 8½ inches wide by 11 inches long. In this case, the letterhead would have a length of 7.5 inches or slightly less. During processing of this composite structure through a printer, the imaging on the letterhead portion may be rotated 90° from the imaging on the envelope portion through suitable software.

Since the envelope 12 may be made of lighter weight paper than the letterhead 11, a less expensive envelope 12 may be used. Conversely, a heavier weight of paper may be used for the letterhead 11 to enhance the appearance and feel of the letterhead 1 1 to a reader.

One of the advantages of the composite form structure is that the envelope 12 may be made in a conventional fashion and separately attached to the letterhead after fabrication.

The invention thus provides a composite letterhead form having a letter and envelope which can be separately manufactured and placed together in a releasably attachable manner. Thus, suitable paper weights may be used for each of the letterhead and the envelope rather than having a single weight of paper used to form a composite letterhead and envelope structure.

The invention further provides a letterhead and envelope combination which can be readily processed through a printer and one in which a substantially standard size letterhead can be fully imaged.

As compared to an integrated composite letterhead/envelope structure, such as described in U.S. Pat. No. 5,377,904, for the same overall dimensions of 8½ inches by 14 inches, the invention provides a letterhead of 10½ inches in length and a sealed envelope size of 3½ inches in height. The structure, for example, as shown in FIG. 4 of U.S. Pat. No. 5,377,904 would either provide a letterhead of 11 inches and an envelope of less than 3 inches in height or an envelope of 3½ inches in height and a letterhead of 9½ inches in height depending upon the height of the flap.

The invention further provides a composite letterhead/envelope structure in which the envelope is provided with a full pocket as opposed to envelopes which are formed by folding over and securing two plies together using inside glue.

The invention further provides a composite letterhead/envelope structure which can be fed through an ink jet printer having the capacity to print colors and to print logos and other graphics.

What is claimed is:

1. A composite form structure comprising a letterhead of rectangular shape and a predetermined weight;

an envelope having a pocket for receiving said letterhead in a folded-over condition and a flap extending from said pocket for folding over said pocket, at least a portion of said flap being releasably attached to said letterhead in overlapping manner; and an adhesive on said flap for sealing of said flap over said pocket.

2. A composite form structure as set forth in claim 1 wherein said envelope is of a lesser thickness than said letterhead.

3. A composite form structure as set forth in claim 1 wherein said adhesive on said flap is a remoistenable glue.

4. A composite form structure as set forth in claim 1 wherein said adhesive on said flap is a pressure sensitive adhesive and said structure further includes a tape removably mounted over said pressure sensitive adhesive and said flap.

5. A composite form structure as set forth in claim 1 which further comprises a second adhesive secured between said letterhead and said flap.

6. A composite form structure as set forth in claim 5 wherein said second adhesive between said letterhead and said flap is one of a fugitive type adhesive and a repositionable type adhesive.

7. A composite form structure as set forth in claim 5 wherein said second adhesive between said letterhead and said flap permanently secures said letterhead to said flap and said letterhead includes a perforation separating said letterhead into a stub disposed over said adhesive for permanent securement to said flap and a removable portion for removal from said flap.

8. A composite form structure as set forth in claim 5 wherein said letterhead is disposed on one side of said flap and said adhesive for sealing said flap over said pocket is disposed on an opposite side of said flap from said letterhead.

9. A composite form structure as set forth in claim 5 wherein said letterhead is disposed over said adhesive for sealing said flap over said pocket.

10. A composite form structure as set forth in claim 1 wherein said letterhead and said flap are aligned along one edge thereof.

11. A composite form structure as set forth in claim 1 wherein said flap is compressed in the area said letterhead is attached to said flap.

12. A composite form structure as set forth in claim 1 wherein said envelope includes a front ply having a pair of inwardly folded over flaps and a back ply secured to and folded over said flaps to form said pocket.

13. A composite form structure as set forth in claim 12 wherein said flap extends from said front ply.

14. A composite form structure as set forth in claim 1 wherein said envelope has a width of 8½ inches and said envelope and said letterhead have an overall length of 14 inches.

15. A composite form structure comprising a letterhead of rectangular shape and a predetermined weight;

an envelope having a front ply with folded over side flaps, a back ply secured to and over said side flaps to define a pocket, and a flap extending from said front ply in overlapping relation to said letterhead;

a first adhesive on said flap securing said letterhead to said flap; and a second adhesive on said flap for sealing said flap to said back ply to close said pocket.

16. A composite form structure as set forth in claim 15 wherein said first adhesive is one of a fugitive type adhesive and a repositionable type adhesive.

17. A composite form structure as set forth in claim 15 wherein said letterhead includes a perforation separating said letterhead into a stub for permanent securement to said flap and a removable portion for removal from said flap and said first adhesive permanently secures said letterhead to said flap.

18. A composite form structure as set forth in claim 15 wherein said first adhesive is on one side of said flap and said second adhesive is on an opposite side of said flap.

19. A composite form structure as set forth in claim 15 wherein said letterhead is disposed over each of said first adhesive and said second adhesive.

20. A composite form structure as set forth in claim 15 wherein said flap is compressed in the area said letterhead is attached to said flap.

21. A composite form structure as set forth in claim 15 wherein said envelope has a width of 8½ inches and said envelope and said letterhead have an overall length of 14 inches.

22. A composite form structure as set forth in claim 21 wherein said envelope has a height of 3½ inches and a width of 8½ inches.

23. A composite form structure as set forth in claim 22 wherein said letterhead is of less width than said envelope.

* * * * *

UNITED STATES PATENT AND TRADEMARK OFFICE

CERTIFICATE OF CORRECTION

PATENT NO. : 6,283,362 B1
DATED : September 4, 2001
INVENTOR(S) : Irving R. Michlin It is certified that error appears in the above-identified patent and that said Letters Patent is hereby corrected as shown below:

Column 1,
Line 3, cancel "This is a provisional application for a patent."

Signed and Sealed this

Second Day of April, 2002

*Attest:*

*Attesting Officer*

JAMES E. ROGAN
*Director of the United States Patent and Trademark Office*